United States Patent [19]

Zimmerman et al.

[11] Patent Number: 4,763,890

[45] Date of Patent: Aug. 16, 1988

[54] SYSTEM FOR SEPARATING AND TRANSFERRING THE UPPERMOST FABRIC PLY FROM A STACK OF FABRIC PLIES

[75] Inventors: Roger W. Zimmerman, Liberty; William S. Jones, Trinity, both of N.C.

[73] Assignee: Blue Bell, Inc., Greensboro, N.C.

[21] Appl. No.: 933,469

[22] Filed: Nov. 21, 1986

[51] Int. Cl.[4] ..... B65H 3/08; B65H 5/22; B65H 5/08; B65H 59/00

[52] U.S. Cl. ..... 271/30.1; 271/5; 271/9; 271/11; 414/121; 414/118

[58] Field of Search ..... 271/9, 5, 11, 14, 97, 271/98, 268; 209/546, 548, 903; 414/121, 118

[56] References Cited

U.S. PATENT DOCUMENTS

| | | | |
|---|---|---|---|
| 3,458,042 | 7/1969 | Mestre | 271/263 X |
| 4,451,191 | 5/1984 | Torre | 271/9 X |
| 4,462,585 | 7/1984 | Gieson et al. | 271/263 X |

*Primary Examiner*—H. Grant Skaggs
*Assistant Examiner*—L. C. Waag
*Attorney, Agent, or Firm*—Charles R. Rhodes; Judith E. Garmon

[57] ABSTRACT

Stacks of fabric plies are sequentially positioned by a carousel feeding apparatus in an unloading position where the uppermost ply in a stack, so positioned, is individually and sequentially separated from the stack, and an edge thereof presented between the jaws of a gripping device. Once the gripping device is satisfied that one and only one fabric ply is in place between the jaws, the single ply is transferred over onto the receiving end of a conveyor for further processing. The fabric separation occurs by means of an aerodynamic technique which tends to lift by suction the uppermost ply from the remainder of the stack. A proximity switch determines the spacing between the gripper jaws which spacing confirms the existence of one and only one fabric ply therein.

14 Claims, 11 Drawing Sheets

SYSTEM FOR SEPARATING AND TRANSFERRING THE UPPERMOST FABRIC PLY FROM A STACK OF FABRIC PLIES

BACKGROUND AND SUMMARY OF THE PRESENT INVENTION

The present invention relates to material handling devices for the apparel industry, and more particularly to a system for mechanically separating and moving the upper ply from a stack of fabric plies.

In the manufacture of clothing it is conventional to lay out fabric in a plurality of layers on a cutting table and then cut out a desired pattern through the entire thickness of cloth layers to form a stack of apparel pieces. Individual pieces of fabric must then be separated from the stack and joined to other components of a garment in the sewing operation. Such fabric parts may include such items as pockets, sleeves, or other garment parts as are required. It is very difficult to mechanically separate a single fabric ply from a stack of identical fabric pieces. Such difficulties arise because fabric is generally not sufficiently stiff, but relatively supple and flexible. Therefore, techniques that operate satisfactorily in connection with sheets of wood, paper, or other articles that are relatively stiff are not generally successfully utilized in connection with fabric plies. Some attempts to mechanize the separation of one fabric ply from a stack of similarly shaped fabric plies include pins, pincers, suction devices, rollers, hooks, barbs, air blasts, frictional buckling devices, and the like.

As an example, one type of fabric ply separating device which utilizes an air blast is illustrated and described in the patent to Carroll U.S. Pat. No. 3,877,695. In the device a stream of air is directed from a single nozzle beneath a curved plate creating an aerodynamic lift tending to separate the upper piece of the fabric from the remaining pieces therebelow and create a rippled configuration in the fabric. A coil spring type gripper is then compressed to pinch the fabric ripples of the upper ply between the coils thereof so that the upper ply may be lifted and removed to a designated receiving area.

Other devices, such as those illustrated in the U.S. patent to Gieson et al U.S. Pat. No. 4,462,585, utilize a mechanical gripping device which indirectly and mechanically senses the distance between the jaws thereof to determine whether one or more sheets have been clamped. The mechanical linkage between the jaws and the measuring device must be precisely set and maintained so that accurate sensing occurs.

In the sequential separation, removal, and transfer of one ply at a time from a stack of fabric plies, several problems must be confronted. First of all, it is necessary to reliably lift and present one and only one ply at a time to a transfer device. Such fabrics as denim are quite heavy and therefore substantial design considerations must be given to providing sufficient air to lift one and only one ply of fabric. Secondly, in contemporary apparel manufacturing processes, it is extremely important that unnecessary steps in the operations be eliminated so that each cycle of operation occurs as quickly as possible. Thus, it is desired to eliminate lost motions such as occur in lifting and lowering prior to and subsequent to the traversing step. Finally, there must be some type of reliable test device for confirming that one and only one fabric ply has been gripped prior to the transfer of such ply to the conveyor mechanism.

Toward this end an extremely simple, reliable, and efficient separation and transfer device has been developed. Stacks of fabric plies are sequentially positioned by a carousel-type feeding apparatus in an unloading position. The uppermost ply in a stack, so positioned, is individually and sequentially separated from the remainder of the stack, and a leading edge thereof presented between the jaws of a gripping device. Once the gripping device is satisfied that one and only one fabric ply is in place between the jaws, the single ply is transferred over onto a waiting conveyor for further processing. The gripping device is so constructed that the jaws thereof open to for an obtuse angle so that the gripping device may be returned quickly to the gripping position without interferring with the free fall of the fabric ply released.

A primary feature of the present invention is the use of an aerodynamic lift means which generates lifting air currents across a substantial portion of the entire width of the upper surface of the uppermost fabric. Further, the gripping means includes an electronic test circuit mounted in one of the jaws thereof which senses the distance between the movable jaw and the stationary jaw responsive to fluctuations in a magnetic field, the magnetic field fluctuations being indicative of the number of plies being held between the two clamping jaws.

The aerodynamic lift mechanism and the gripping device which includes the test circuit therein are unique in and of themselves, in addition to the manner in which they cooperate with each other and with the remainder of the overall apparatus. Further, the carousel apparatus is unique in the manner in which a plurality of stacks of fabric plies are fed to an unloading station and sequentially lifted a distance equal to a single ply so that the uppermost unloaded ply of the stack is always at the same elevation for reliable presentation to the aerodynamic lift mechanism.

Referring now to the various components of the invention, the rotatable carousel member includes, in general, a planar member having a plurality of spaced openings therethrough arranged in a circular path thereon. The fabric bins are so mounted on the aforesaid planar member that each bin overlies one of the openings. Each bin further includes a vertically reciprocal base plate and stationary upstanding side support elements extending upwardly therefrom for storing a stack of fabric plies therein. An elevator or elevator means in the form of a linear actuator is vertically mounted on the base frame of the apparatus at the unloading position in registration with an opening in the planar member which has been moved into registration therewith. The linear actuator is movable between a first position in which the free end thereof is at a level beneath the base frame and a plurality of lifting positions in which the free end of the linear actuator engages and sequentially lifts the base plate of the fabric bins higher and higher as fabric plies are moved from the stack thereabove.

The aerodynamic lift means includes an air foil having a horizontally extending, planar rear portion and an upwardly inclined or curved front portion, the aforesaid plate having a width substantially coextensive with the major portion of the width of the fabric plies. An elongated air manifold housing having an upper surface, a lower surface, and a front wall is attached to the undersurface of the rear planar portion of the aforesaid air foil. The manifold housing has an open top trough in the upper surface thereof that extends along the major portion of the length and a plurality of spaced, horizontal passageways or a slot extending from the aforesaid trough forwardly through the front wall. The rear planar portion of the air foil is sealed against the upper surface of the manifold housing to cover the trough and pressurized air is applied to the trough. So formed, a thin sheet of air is then directed between the upper surface of the fabric ply and the air foil toward the front edge of the fabric ply. The air tends to follow the inclined forward portion of the air foil and aerodynamically lift the leading edge of the upper ply from the remainder of the stack from whence it is presented to the gripping device.

The gripping device, according to the present invention, includes a stationary support block having a planar base that forms a first stationary clamping jaw and a second clamping jaw that is pivotally linked to the support block and to a linear actuator mounted within the support block for moving the lower jaw back and forth between the clamping position adjacent the stationary upper jaw and a receiving position in which the lower jaw is arcuately withdrawn through an arc of substantially 120° for purposes to be hereinafter described. A proximity switch mounted in the support block adjacent the planar face of the stationary clamping jaw generates a magnetic field which senses the position of the lower jaw with respect to the upper jaw, such relative position being indicative of the number of plies held between the clamping jaw.

Once a fabric ply is gripped and the proximity switch indicates that a single ply only is gripped, the gripping device holding a single ply is transferred laterally to a position overlying the receiving end of an off-bearing conveyor. The lower jaw is then pivotally moved to its wide open release position allowing the fabric ply to freely drop while the support block is rapidly moved back to its home position for receiving a new fabric ply. Because the lower jaw opens so wide there is no interference between the lower jaw and the released fabric ply during the return stroke. Should the proximity switch indicate a "fault" in which no plies or more than one ply is held between the gripping jaws, the gripping device is returned to the open position and the aerodynamic lift means is recycled to commence the separating step again.

It is therefore an object of the present invention to provide an improved apparatus for separating and lifting the uppermost fabric ply from a stack of fabric plies to sequentially remove and transfer plies one at a time to a conveying means or work station.

It is a further object of the present invention to provide an improved gripping device for holding a prescribed number of fabric plies therein to confirm that the number of plies is a prescribed number.

Another object of the present invention is to provide a device for separating one edge of the uppermost fabric from a stack of fabric plies utilizing an aerodynamic lift technique.

Another object of the present invention is to provide an apparatus of the type described in which the gripping device indicates an improper number of plies in the case of a "fault" and returns partially separated plies to their original position on the stack for reprocessing.

Yet another object of the present invention is to provide an apparatus for presenting stacks of fabric plies to a fabric separation device which sequentially removes and transfers fabric plies one at a time.

Other objects and a fuller understanding of the invention will become apparent from reading the following detailed description of a preferred embodiment along with the accompanying drawings in which.

Figure 7:
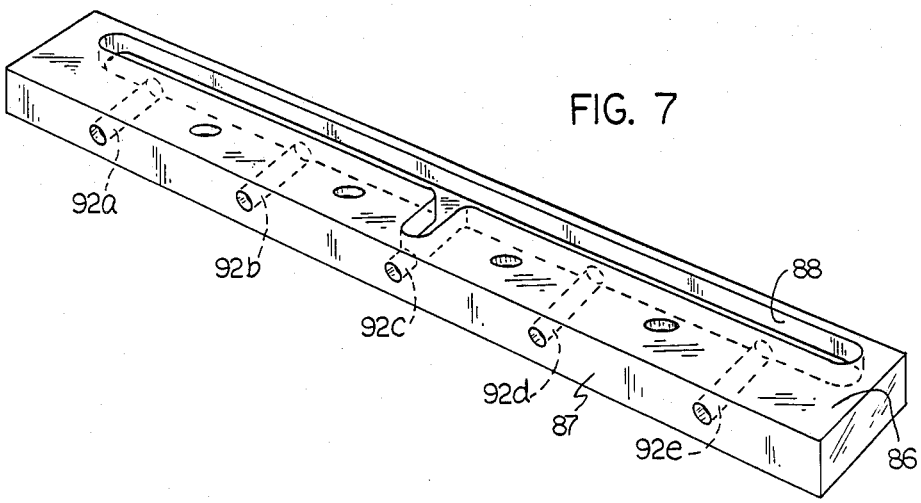
Figure 1:
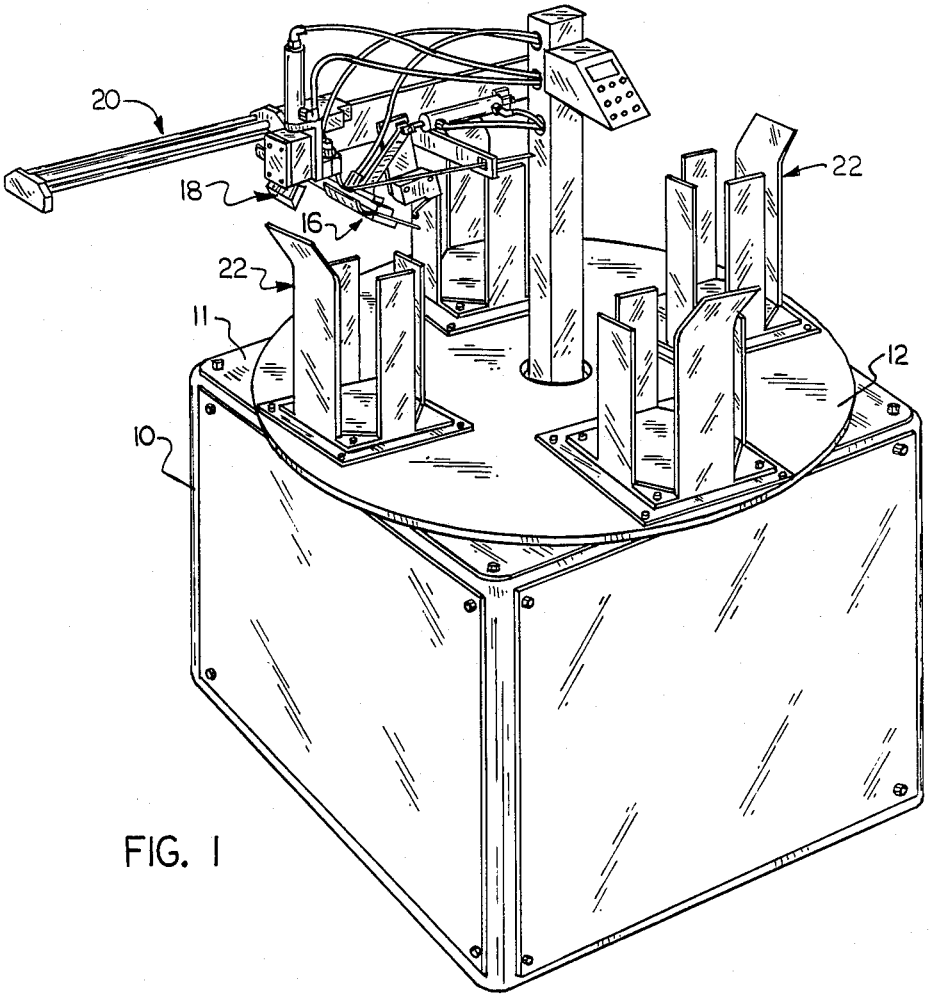
FIG. 1 is a perspective view of the entire separating, gripping, and transfer apparatus according to the present invention.
Figure 8:
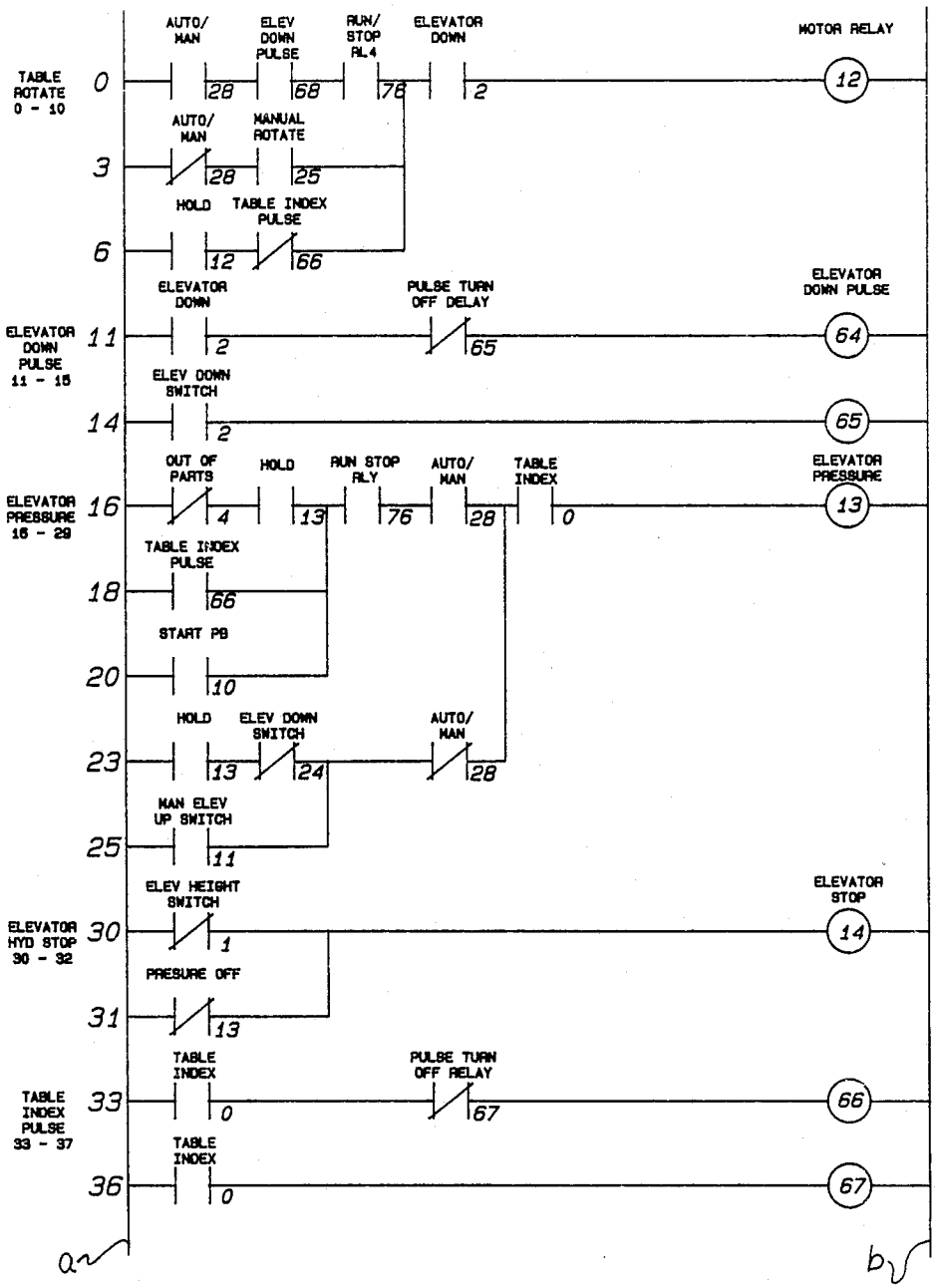
Figure 8:
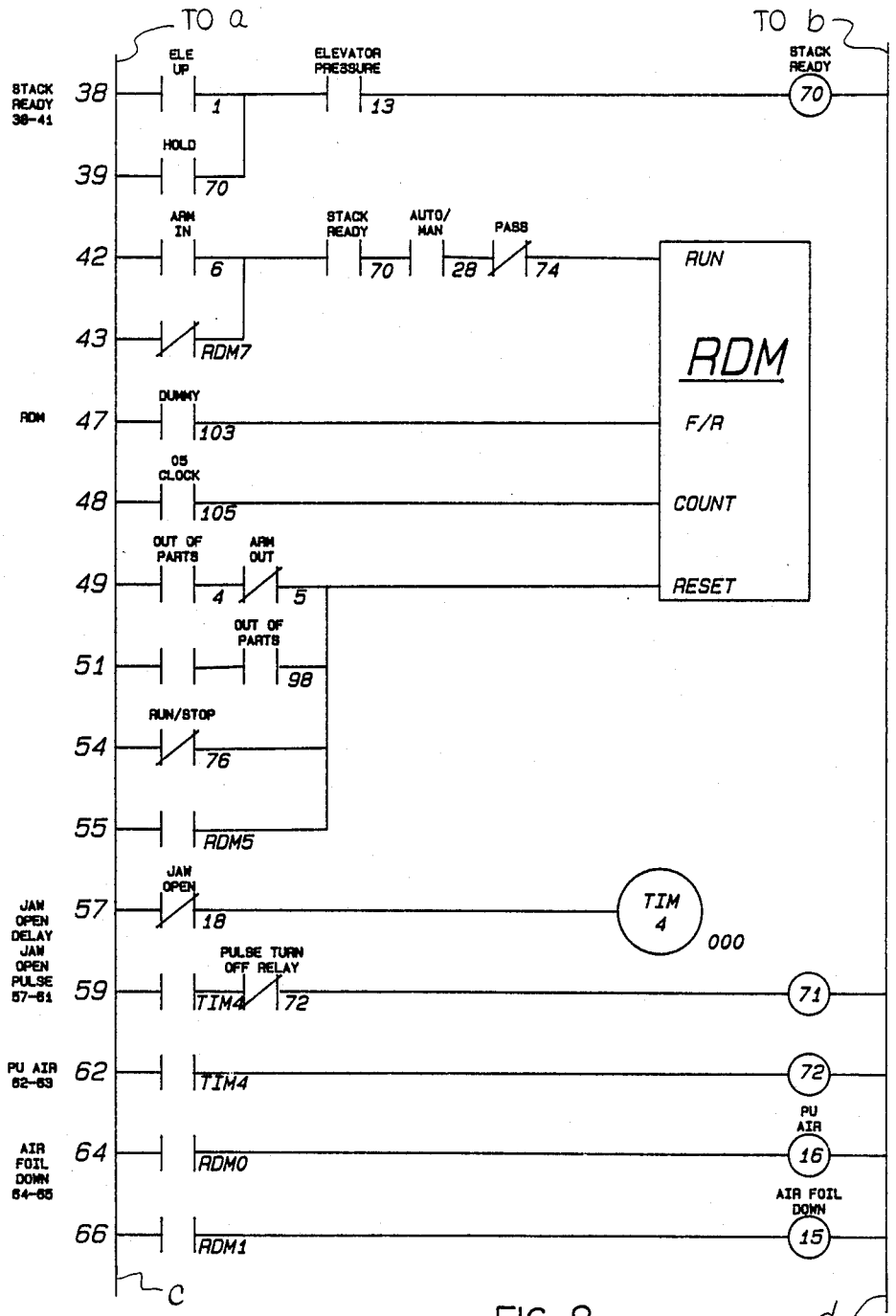
Figure 8:
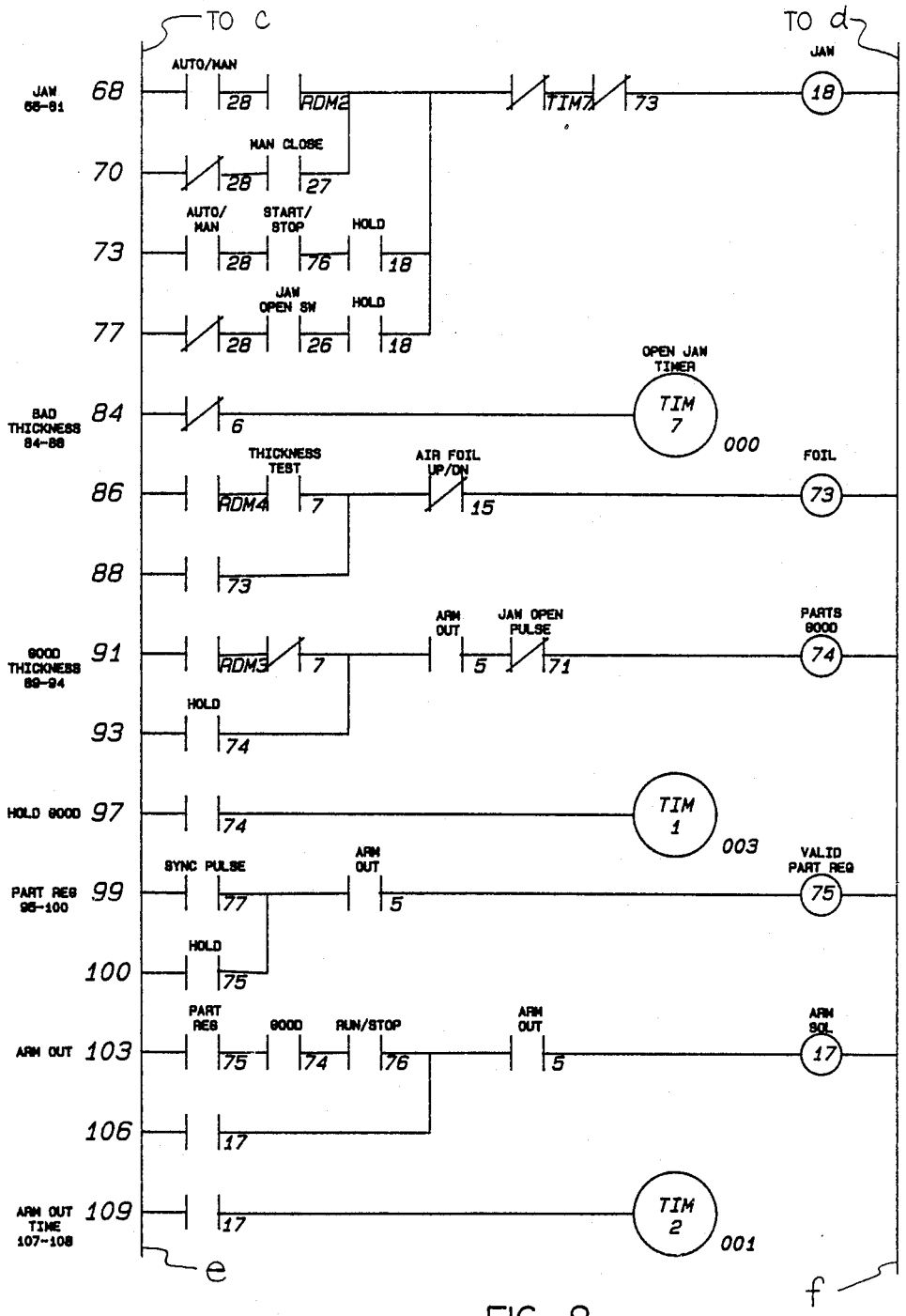
Figure 8:
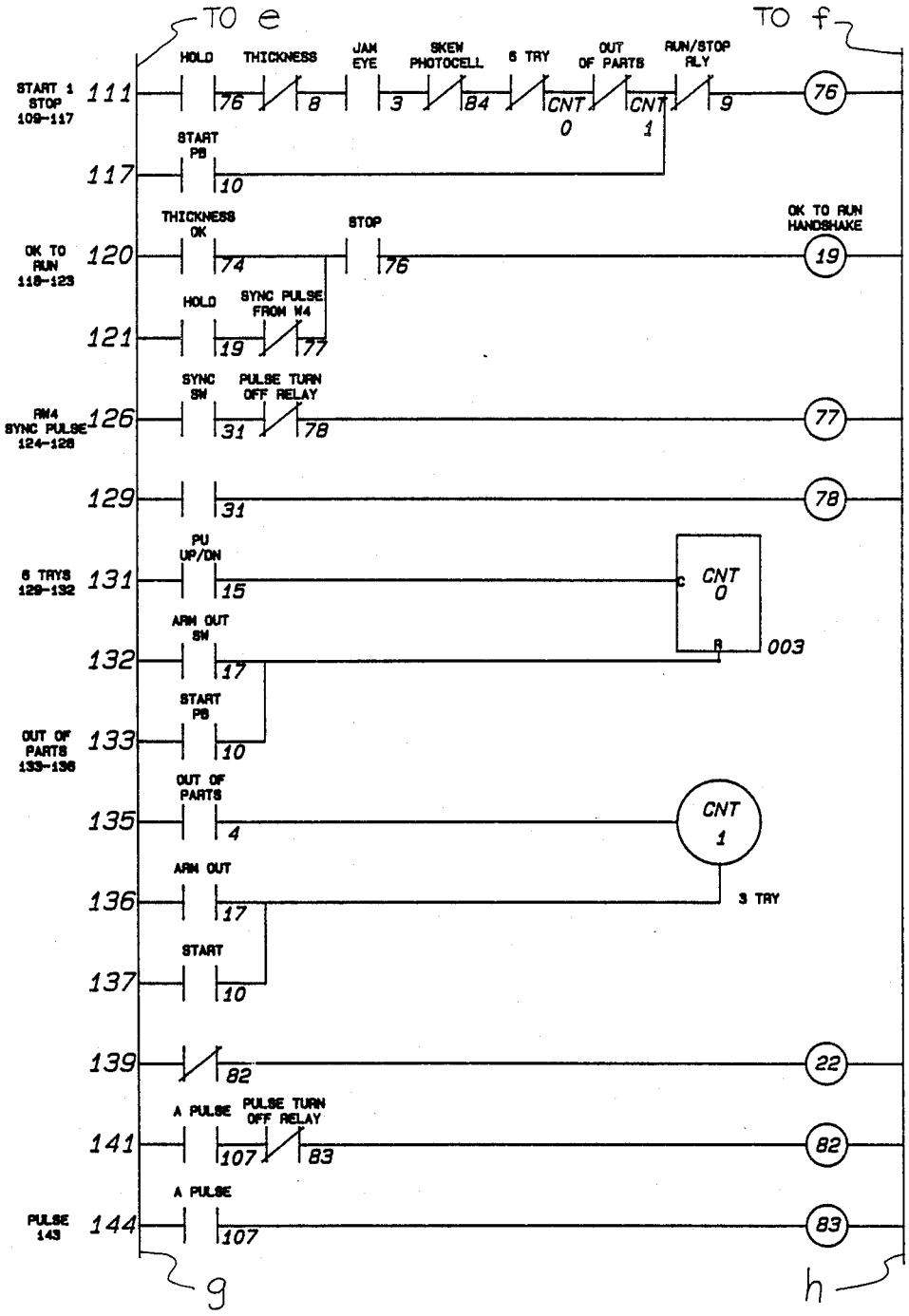
Figure 8:
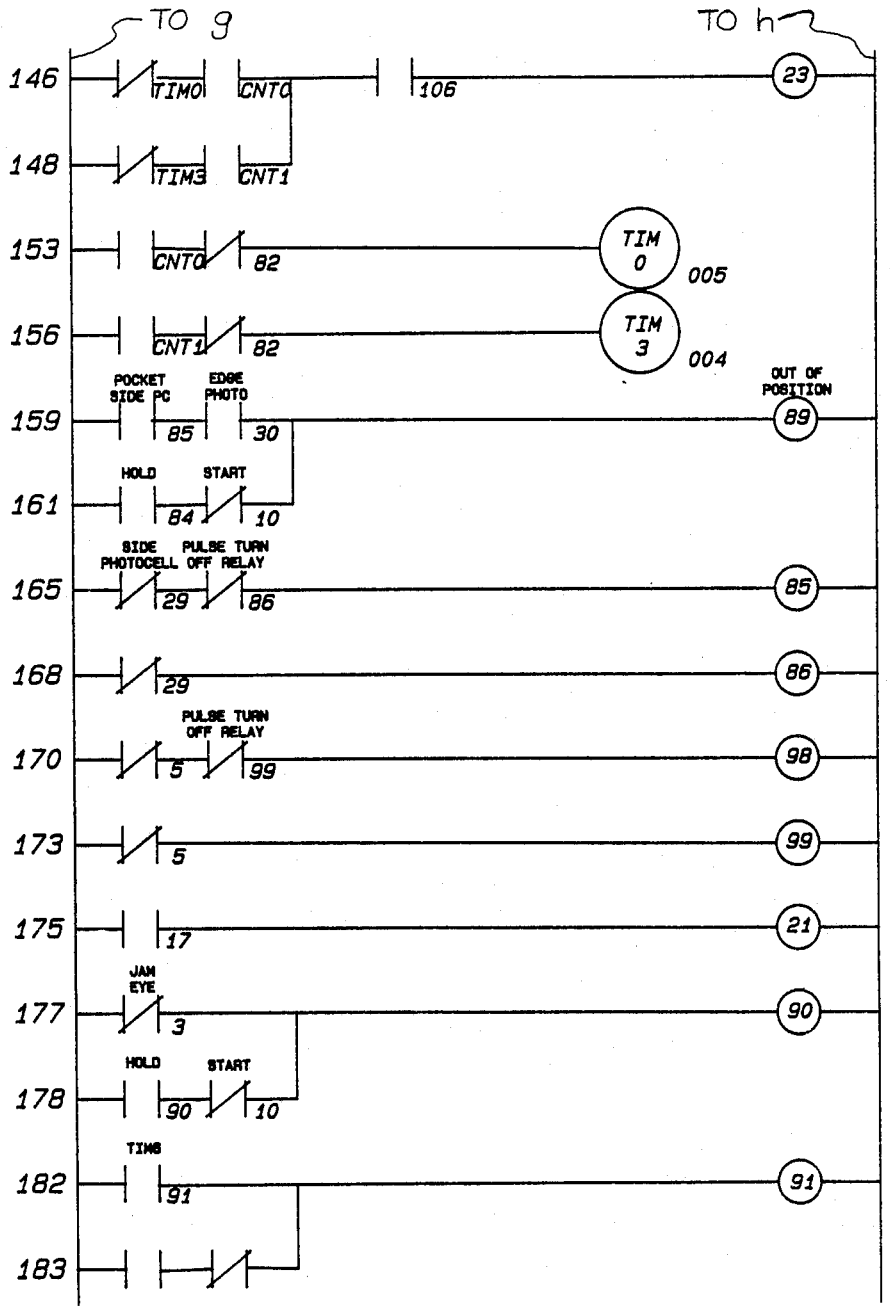

FIGS. *6a–6f* are schematic representations illustrating the sequential operation of the apparatus; and FIG. 7 is an enlarged perspective view of the air manifold housing alone separated from the aerodynamic lift mechanism; an FIG. 8 is a program operational chart illustrating the control programming of the apparatus of FIG. 1.

DETAILED DESCRIPTION OF A PREFERRED EMBODIMENT

Turning now to the drawings and more particularly to FIG. 1 there is illustrated the entire apparatus according to the present invention in the assembled form. The main components of the present invention include a base frame 10, a carousel member 12 mounted for rotation on said base frame and having a plurality of fabric bins 22 thereon in spaced arrangement around the periphery thereof; an elevator means associated with each fabric bin 22 as it is moved to an unloading position for incrementally raising the stack of fabric in the overlying fabric bins; an aerodynamic lift means 16 which is positioned adjacent the upper end of the fabric bin for generating lifting air currents across the width of the upper surface of the uppermost fabric; a gripping means 18 for receiving a fabric ply presented thereto by the lift means 16, the gripping means 18 including a test device mounted in association therewith for determining the number of plies held by the gripper means; and a transfer means 20 for moving the gripping means 18 from a receiving position to an unloading position.

Carousel Feeding Mechanism

Figure 2:
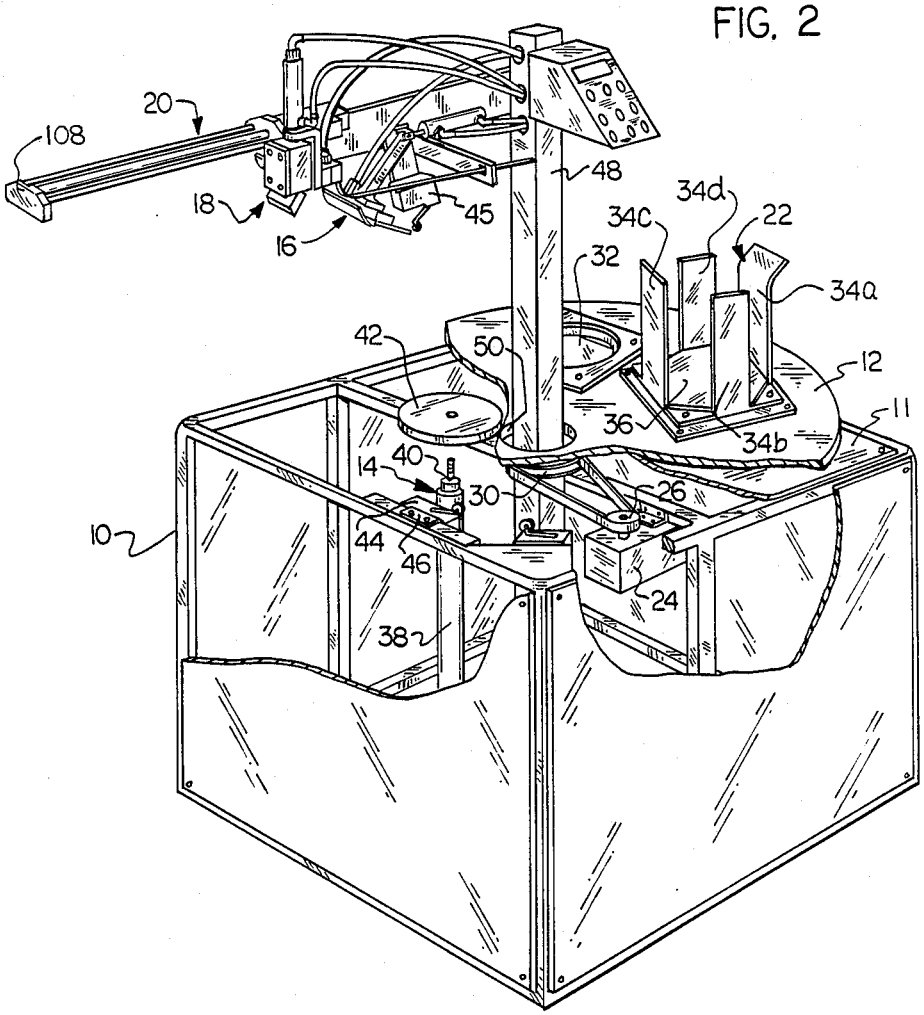
FIG. 2 is a perspective view of the carousel of the present invention exploded from the base frame.

Turning now to FIG. 2 there is illustrated the carousel feeding device 12 exploded from the main frame 10. Main frame 10 is formed of a plurality of legs and cross members in any conventional manner so as to form some type of base frame or table. A planar top 11 is optional. A drive motor 24 is suitably secured to the frame 10 in any conventional manner so that the output shaft 26 thereof which includes some type of pulley and belt assembly 28 selectively drives a table pulley 30, which in turn is secured to the underside of the carousel member 12. A plurality of openings 32 are provided in the carousel, the number of openings 32 being dependent upon the number of fabric bins 22 to be provided on the upper side thereof. A fabric bin 22 is associated with each opening 32 and in this respect a plurality of upstanding walls **34*a*–34*d* plates, etc. are secured to and extend upwardly from the surface of the carousel member 12 in a pattern surrounding each opening 32. The walls 34*a*–34*d* provide support in each direction for the stack of fabric members to be provided therein as hereinafter described. Each fabric bin 22 includes a vertically reciprocal base plate 36 which is lifted by elevator means 14** sequentially upward during the unloading of the stack thereon and then returned to its lowermost position upon completion of the unloading of a stack by the elevator means as will be hereinafter described.

The elevator means 14 includes a linear actuator, preferably a hydraulic cylinder 38 secured in a generally vertical attitude to the base frame 10. As such fabric bin 22 is moved to the unloading position, cylinder 38 becomes aligned with the center of the corresponding opening 32. In situations where a table top 11 is provided for the base frame 10, it should be understood that an opening in the table top must be provided through which the elevator assembly can have access to the fabric bin thereabove.

The piston or actuator rod 40 of the hydraulic cylinder 38 includes a lift pad 42 attached to the free end thereof. So arranged, when a fabric bin 22 is moved into position above the elevator assembly 14 the piston 38 is withdrawn to a retracted position in which the lift pad 42 is beneath the plane of rotation of the carousel member 12. Once the fabric bin 22 has been positioned in the unloading position and locked therein, the cylinder 38 is activated to extend the actuator rod 40 sequentially in steps to gradually lift the stack of fabric plies so that the uppermost ply is always at the same horizontal level for operation thereon by the aerodynamic lifting means 16. A limit switch 44 is positioned adjacent the lowermost position of the lift pad 42 by a mounting bracket 46 to indicate to the motor 24 that the unloading has been completed and the elevator has returned the base plate 36 to the bottom of the fabric bin 22. Thereafter the motor 24 may be activated to rotate the carousel member 12 so that the next fabric bin to be unloaded is properly registered in the unstacking position. An upper limit switch 45 positioned adjacent the upper end of the fabric bin 22 signals the aerodynamic lift apparatus 16 when the uppermost ply is at the proper horizontal level.

Aerodynamic Lift Mechanism

Figure 3:
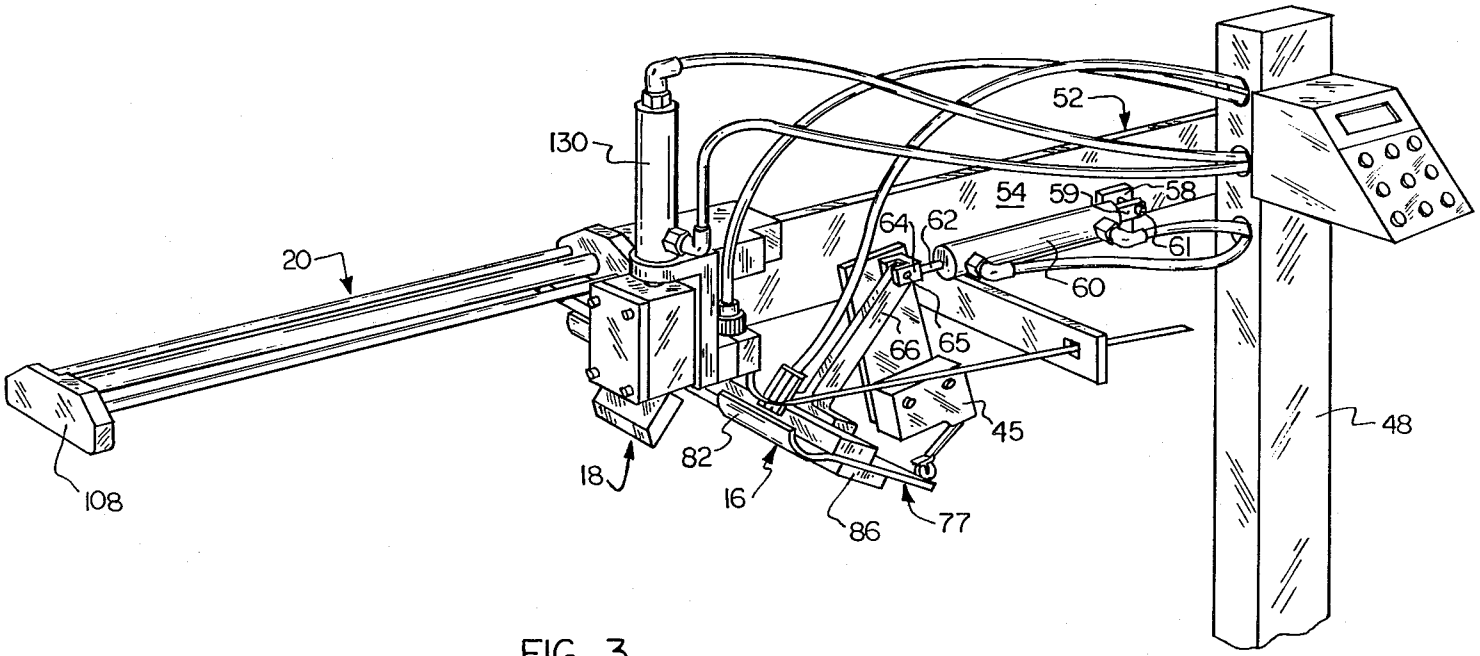
FIG. 3 is an enlarged perspective view of the gripper/transfer mechanism and the aerodynamic lift mechanism of the present invention.
Figure 4:
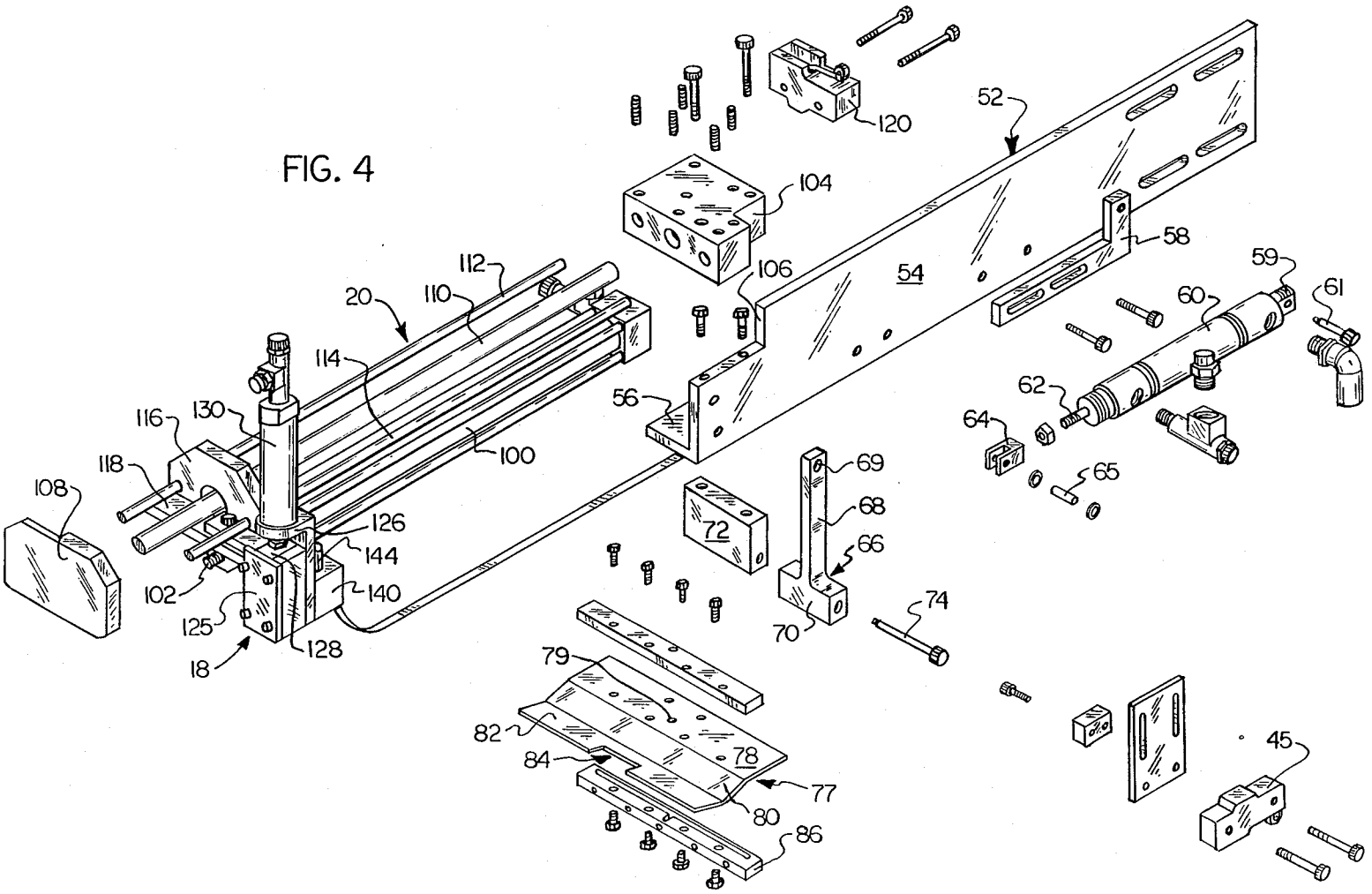
FIG. 4 is an exploded perspective view of the aerodynamic lift mechanism.

As best illustrated in FIGS. 3, 4, and 7, the aerodynamic lift means 16 is suitably supported adjacent the upper end of the fabric bin 22 that is in the unloading position at any one time. Toward this end the base frame 10 includes an upstanding center column 48 which extends through a central opening 50 in the carousel member 12. A support mechanism includes a horizontal support arm 52 secured to the center column 48 and extending outwardly therefrom to a position overlying the aforementioned unloading position. In the preferred embodiment illustrated in FIGS. 3 and 4, the support arm 52 is an angle bracket having a vertical wall 54 and a horizontal wall 56. An L-shaped mounting bracket 58 is adjustably attached to the vertical wall 54 and pivotally supports the base end 59 of a hydraulic cylinder 60 by means of a pin 61 which extends through the projection 59 at the base end of cylinder 60 and into the mounting bracket 58. So arranged the cylinder 60 is pivotally reciprocal in an arcuate path for reasons to be hereinafter described. The free end of piston 62 of the hydraulic cylinder 60 is provided with a clevis 64.

A lifting arm 66, formed as a T-shaped member having an enthickened cross member 70 and a longitudinally extending leg 68, is pivotally attached at the rear end thereof to the clevis 64 by means of a pivot pin 65 which extends through opening 69. A second pivot pin 74 extends through a passageway 71 in cross member 70 to pivotally mount the lift arm 66 to a support block 72, which in turn is mounted to the underside of the horizontal portion 56 of the support arm 52 near the front or free end thereof.

The aerodynamic lift means 16 itself is formed primarily by an air foil 77 which includes a rearmost horizontal planar portion 78, a downwardly inclined intermediate portion 80, and an upwardly inclined portion 82. An intermediate cut out 84 is provided in the upwardly inclined front portion 82 for reasons to be hereinafter described. The air foil 77 is attached to the underneath side of cross member 70. An air manifold housing 86 is secured to the underneath surface of the rear planar portion 78 of the air foil. The air manifold 86 includes a body member extending substantially the width of the air foil. An air delivery trough 88 is provided in the body member 86 for distributing air from an entrance groove 90 to a plurality of passageways **92*a*–92*e* which extend from trough 88 through the body member 86 and through the forward wall 87 thereof. Alternatively the passageways 92*a*–92*e* might appear as a slot or slit in the forward wall 87, thus forming a horizontally extending air outlet means. So arranged, air is delivered through an opening 79 in the rear planar portion and into the receiving groove 90 of the manifold 86. Such air from a single source is diverted and transformed into a sheet of air that passes between the air foil formed by the downwardly inclined surface 80 and upwardly inclined front surface 82 and the upper layer of fabric being lifted. It should be recognized here that the inclined planar sections 80,82** could be replaced by a gradually curving front surface similar to the front end of a toboggan or sled. Either of such configurations cause the sheet of air exiting from the air manifold to curve upwardly tending to create an area of vacuum or suction lifting the front edge of the upper fabric ply.

The lift arm 66 is activated by the hydraulic cylinder 60 to arcuately reciprocate the air foil 77 between a pickup position in which the air manifold is generally horizontal and adjacent the upper ply of fabric and a delivery position in which the front edge of the fabric ply, once lifted, is presented to the jaws of a gripping means 18 as will be hereinafter described. To effect the arcuate movement as the piston 62 of the hydraulic cylinder 60 reciprocates, the arm 66 rocks or oscillates about the pivot point or axis formed by the pivot pin 74. Thus, a relatively long stroke of the piston 62 causes the lifting of the front end of the cross member 70. Toward this end, of course, the necessity for the pivoted rear end 59 of hydraulic cylinder 60 should be recognized.

Finally, before leaving a discussion of this portion of the apparatus, the aforementioned elevator up limit switch 45 is secured to the vertical wall 54 as illustrated in FIG. 3 in proper position to sense the arrival of the upper ply of fabric in the stack at the proper horizontal level.

Fabric Ply Gripping, Testing, and Transfer Mechanism

The gripping and testing mechanism 18 is, in general, supported by the transfer mechanism 20. Toward this end a double acting hydraulic cylinder 100 is mounted on the horizontal ledge 56 of the support arm 52 with the actuating piston 102 of cylinder 100 having an axis generally parallel with the longitudinal axis of support arm 52. A tail stock 104 is mounted in a notch 106 in the vertical wall 54 of support arm 52. A head stock 108 is positioned at a point spaced from the tail stock 104 by parallel support rods 110,112, and 114, which in turn are secured in the tail stock 104. So arranged, the slide carriage 116 is slidably positioned along the support rods 110,112, and 114 between a receiving position adjacent the tail stock 104 overlying the corresponding fabric bin 22 in the unloading position therebeneath and a discharge position adjacent the head stock 108 which overlies the off-bearing conveyor.

The slide carriage 116 includes a lower portion 117 having a threaded opening 119 therein for receiving the free threaded end of the piston 102. Thus, as cylinder 100 is activated carriage 116 is caused to slide longitudinally along the support rods 110,112, and 114. Support rods 112 and 114 extend through openings in carriage 116 and in order to provide a good sliding relation bushings 113 are provided between the rods 112,114 and the walls of the openings in carriage 116. A limit switch 120 is secured to the tail stock 104 and appropriately positioned so that upon the return stroke of cylinder 100 the slide carriage 116 is caused to engage the limit switch 120 to indicate that the gripping device 18 has returned to the receiving position ready for the presentation of a new fabric ply. Slide carriage 116 includes a horizontally extending ledge 118 to which the gripping device 18 is mounted as illustrated in FIG. 5.

A gripper jaw actuator housing 122 is suspended from ledge 118. For this purpose the actuator housing 122 includes a rear wall **122*a*, a front wall 122*c*, and two side walls 122*b*, 122*d*. A horizontal arm extends outwardly from one of the side walls 122*b* in overlying relation to the ledge 118 where it is secured. The housing 122 is hollow and contains a slide block 128 therein. A mounting plate 126 is secured to the upper edge of rear wall 122*a* and supports a gripper jaw actuating cylinder 130 upstanding thereon. The cylinder 130 includes a piston 132 extending down into the hollow interior of the actuator housing 122 through an opening 127 in the mounting plate 126. As the actuator rod moves up and down a slide block 128** attached to the free end thereof is also caused to reciprocate vertically.

The underside of slide block 128 includes a slot 129 extending from front to rear thereof which slot receives the upper end of a lever arm 134 which is pivotally mounted therein by a mounting pin 135. A lower, movable gripper jaw 136 includes a pair of parallel, spaced mounting fingers 138 extending upwardly and rearwardly therefrom. The lower end of lever 134 is pivotally mounted between the base of fingers 138 by means of a pin 137. The free ends of fingers 138 are pivotally mounted between the spaced legs **123*a*,123*b* of rear wall 122*a* by means of a mounting pin 139**.

Figure 5:
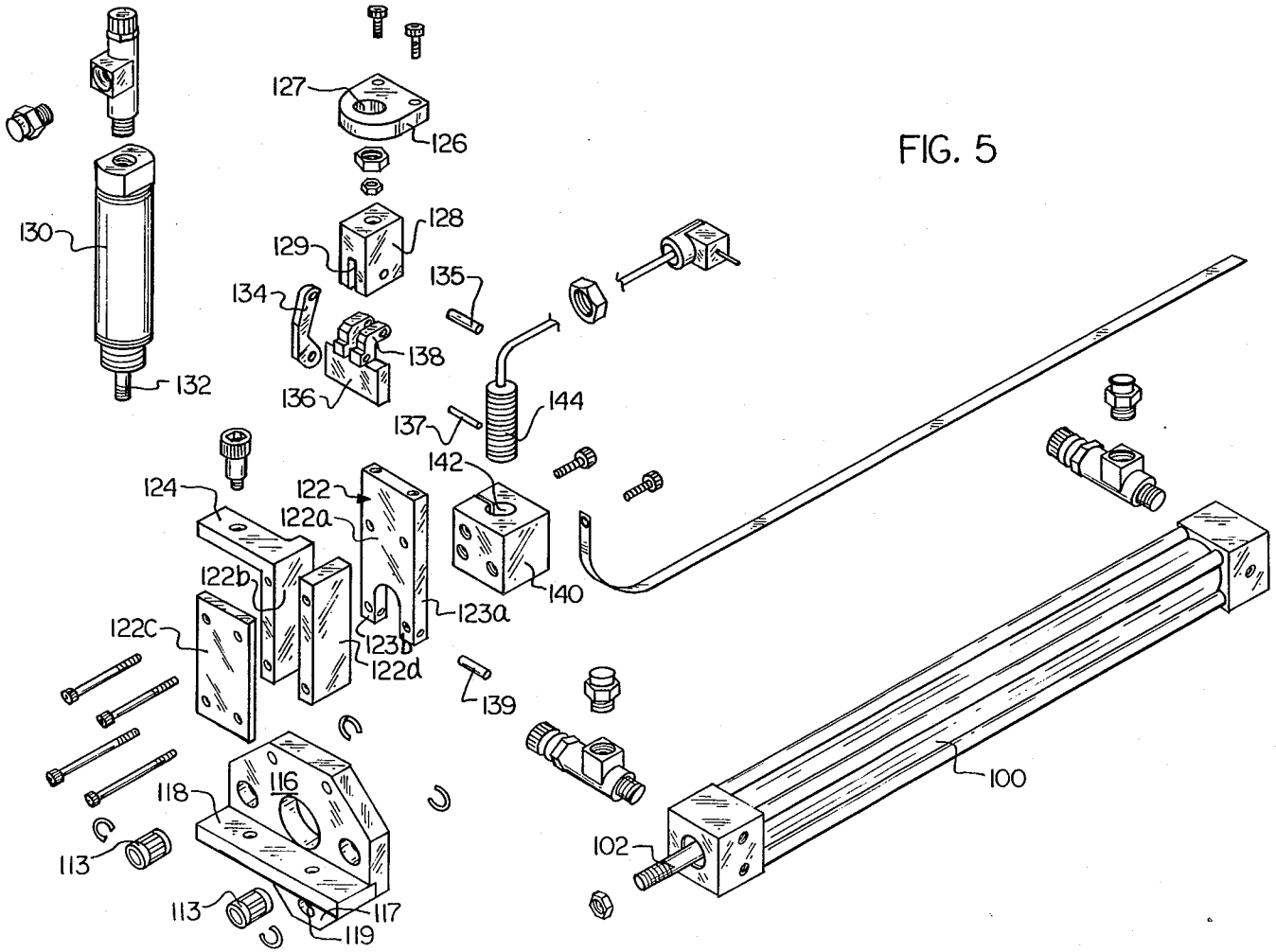
FIG. 5 is an exploded perspective view of the gripper/transfer mechanism.

A stationary housing 140 is secured to the rear side of rear wall **122*a* as illustrated in FIG. 5 and includes a vertical passageway 142 therethrough. A proximity switch or sensor 144 is inserted into and mounted within passageway 142. The lower surface or wall of control housing 140 forms the stationary upper gripping jaw which cooperates with the movable gripping jaw 136** to grip therebetween fabric panels presented thereto.

Figure 6C:
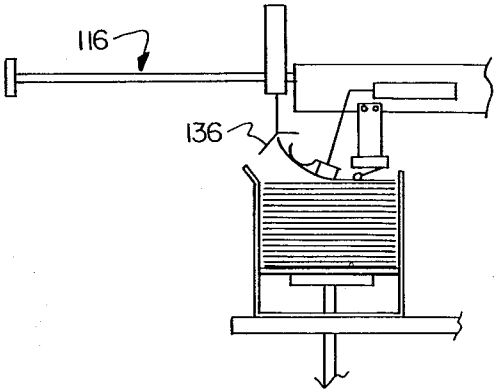
Figure 6B:
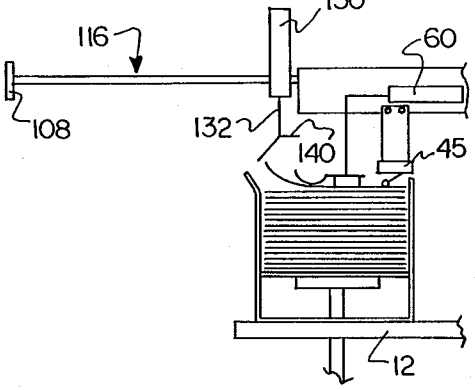
Figure 6A:
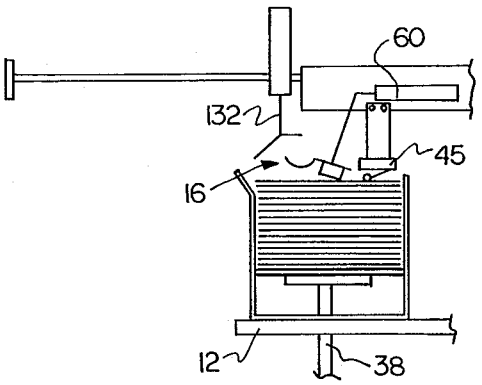
Figure 6F:
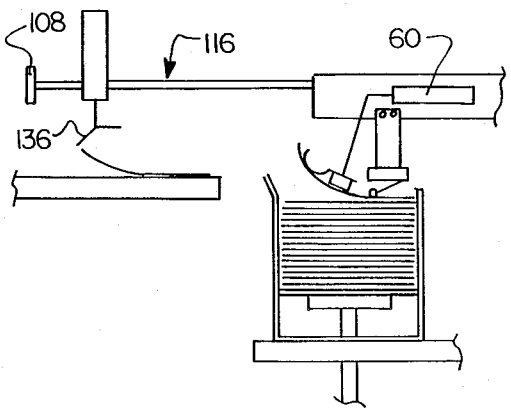
Figure 6E:
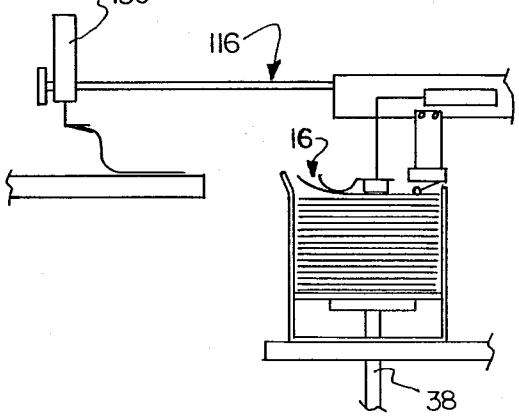
Figure 6D:
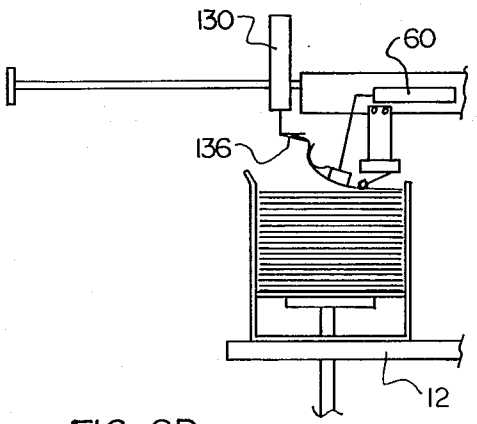

As illustrated in FIG. 6, as the slide 128 is moved from an uppermost position (FIG. **6*c*) in which the lower, movable gripping jaw is open the lever 134 acting on the lower gripping jaw 136 causes the lower gripping jaw to pivot to the closed position closely adjacent the stationary gripping jaw (FIG. 6*d*). At such time as the lower gripping jaw is in the closed position the magnetic field generated by the proximity switch 144 is sensed. The resulting current reading is indicative of the relative spacing between the movable gripper jaw 136 and the stationary jaw (lower surface of housing 140). Where the preset conditions of the measuring device are satisfied indicating a single ply being held by the gripping apparatus 18, the transfer cylinder 100 is activated. However, should the proximity sensor indicate a fault condition in which no plies or more than one ply are present between the gripping jaws, the gripping jaw activating cylinder 130 is withdrawn moving the lower gripping jaw 136 back to its open position. Further, the air foil tilt cylinder 60 is extended lowering the aerodynamic lift means 77** back to its pickup position and the source of air pressure is cut off. Thus, the apparatus is ready for recycling to attempt to lift a single fabric ply.

Turning now to FIG. 6 the entire sequence of operation is shown. First, after the carousel 12 has moved a full fabric bin 22 into the unloading position the elevator cylinder 38 is activated to move the uppermost ply of fabric into the proper horizontal level (FIG. **6*a*). The aerodynamic lift mechanism 16 is then lowered into the proper position and the air supply activated (FIG. 6*b*). As the front edge of the uppermost ply is lifted by the vacuum produced the lift cylinder 60 is activated to retract the piston thereof and arcuately lift the aerodynamic lifting means into the fabric presentation position with the front edge of the fabric ply in position beneath the stationary jaw 140 (FIG. 6*c*). The gripping jaw actuating cylinder 130 is then extended to close the lower gripping jaw 136 (FIG. 6*d*). When the proximity sensor indicates that a single ply is present between the gripping jaws, the air pressure fed to the aerodynamic lift means is released and the transfer cylinder 100 is activated to extend the piston 102 thereof (FIG. 6*e*). The slide carriage 116 is then moved along support rods 110,112, and 114 to the position atop the off-bearing conveyor, at which time the lower gripping jaw is retracted and the fabric ply released. Immediately upon retraction of the lower gripping jaw, the transfer cylinder is reversed to retract the slide carriage to the receiving position (FIG. 6*f*). Jaw 136** is retracted through an arc exceeding 90° so as not to interfere with the free fall of the fabric ply during the return stroke.

Meanwhile, the aerodynamic lift means has lifted the successive fabric ply. As soon as the slide carriage 116 returns to the retracted position and engages the microswitch 120, the air foil tilt cylinder 60 is again activated to present another fabric ply between the gripping jaws.

As described hereinabove, when the proximity sensor 144 indicates a fault condition the aerodynamic lift means is returned to the pickup position and another attempt at picking up a single fabric ply is made. Should a defined number of attempts fail to successfully lift and grip a single fabric ply the elevator 14 is signaled to retract and wait for the attendant. The operator can determine the reason for the faulty operation of the equipment. The carousel 12 is also so designed with a control system such that the carousel can either sequence to the next successive fabric bin, or the carousel motor may be controlled so that any pattern of sequence bins can be presented to the unloading station.

Operational Program

Referring now to FIG. 8 there is illustrated the operational program by which the microprocessor controls the sequencing of events in the apparatus illustrated in FIGS. 1–7. Toward this end, and assuming the apparatus is operating in the automatic mode, a pulse from the Elevator Down switch is received at a time when a run/stop relay is in the "ON" mode indicating that the elevator assembly has returned to the down position. This is the proper time for the carousel to be rotated and the table motor relay will be activated. The activation of the table motor relay may also occur if the apparatus is in the manual mode and a manual rotate start switch is activated. The motor relay holding contact will keep the motor running until the table index pulse releases the holding contact.

Again where the apparatus is in the automatic condition the elevator pressure solenoid will turn on the hydraulic pressure to cylinder 38 upon receipt of a table index pulse or from the out-of-parts switch. Subsequently, the elevator height control switch 45 will regulate the hydraulic elevator relay to control the height of the elevator during sequencing thereof. When all fabric plies in the stack have been removed, and upon deactivation of the hydraulic pressure valve, the second hydraulic valve will open to relieve the hydraulic pressure and allow the elevator to lower.

All of the subsequent operations are controlled by an RDM counter that includes a plurality of control relays, each of which may be utilized to activate occurrences between various counts. For instance, if the relay designated RDM1 is programmed to be on between counts one and eight, it can be used to turn on a solenoid between counts one and eight. One or more of such RDM relays control the timing on the air pickup and jaw closure as described hereinbelow. RDM0 initiates the pickup air between counts one and twenty-seven. RDM1 activates the air foil tilt cylinder 60 between counts one and eight. RDM2 activates the gripping jaw cylinder 130 between counts twenty-two and twenty-three. RDM3 tests for fabric thickness failures from counts twenty-eight to twenty-nine, and RDM4 tests for thickness passes from counts thirty to thirty-two. RDM5 then resets the pickup arm 68 for a successive try at count fifty. Assuming a thickness pass condition, the cylinder 100 will be activated to extend slide carriage to the off-bearing conveyor, whereupon the pulse is generated to release the gripping jaws cylinder 130 and retract the transfer cylinder 100.

While a preferred embodiment of the present invention has been described in detail hereinabove, it is apparent that various changes and modifications might be made without departing from the scope of the invention a set forth in the accompanying claims.

What is claimed is:

1. Apparatus for separating and lifting the uppermost ply of fabric from a stack of fabric plies to sequentially remove and transfer plies one at a time to a conveying means or work station comprising:

(a) a base frame;

(b) a rotatable carousel member mounted on said base frame and having a plurality of fabric bins mounted thereon in spaced arrangement around the periphery thereof, said bins being sequentially arranged in an unloading position one at a time, motor means associated with said base frame for rotating said carousel to move a full fabric bin into said unloading position responsive to completion of the unloading of another said bins;

(c) elevator means associated with each of said fabric bins for incrementally raising said stack of fabric plies as the uppermost of said plies is removed, whereby the uppermost ply is positioned at a prescribed level in preparation for each removal operation therefrom;

(d) an aerodynamic lift means for generating a sheet of lifting air currents, said sheet extending across a substantial portion of the entire width of and adjacent to the upper surface of the uppermost fabric ply on either side of the longitudinal center line thereof and being directed toward a front edge thereof, said aerodynamic lift means comprising an air jet manifold adjacent the upper surface of said uppermost ply for directing a thin sheet of air currents between said upper surface and a curved air foil positioned in the path of said sheet of air, said air foil comprising a planar plate portion extending generally parallel to and spaced from the uppermost ply and an upwardly curved front end with said air jet manifold attached to and suspended form said planar plate portion, said plate portion serving to confine said sheet of air between the upper fabric ply and said planar portion and force said sheet of air toward said upwardly curved front end, whereby the sheet of air tends to separate the front end of said upper ply and lift it into contact with said air foil;

(e) means for moving said aerodynamic lift means in an arcuate path from a pick-up position to a delivery position in which the front edge of said fabric ply is presented to a gripping means;

(f) said gripping means including a stationary support block having a planar face forming a first stationary clamping jaw and a second clamping jaw movable relative to said first jaw between an open receiving position and a closed clamping position in which one edge of at least one fabric ply is held therebetween;

(g) an electronic test means associated with said stationary jaw and generating a magnetic filed for determining the distance between said movable jaw and said stationary jaw in the gripping position responsive to the strength of said magnetic field, said magnetic field strength being indicative of the number of plies being held between said clamping jaws; and (h) transfer means associated with said gripping means for moving said gripping means between a receiving position atop said unloading station and a discharge position adjacent said conveying means, whereupon said second clamping jaw is moved to said open position to release said fabric ply.

2. The apparatus according to claim 1 wherein said movable jaw is released and the fabric ply returned to its initial position atop said stack of fabric plies responsive to a fault signal from said electronic test means.

3. The apparatus according to claim 1 wherein said aerodynamic lift means comprises:

(a) a plate member having a horizontal planar rear portion, a downwardly inclined intermediate portion, and an upwardly inclined front portion, said plate having a width substantiallyu coextensive with the major portion of the width of said fabric plies;

(b) an elongated air manifold housing having an upper surface, a lower surface, and a front wall attached to the undersurface of the rear portion of said plate member, said housing having an open top trough in the upper surface thereof extending along the major portion of the length thereof, and a horizontally extending outlet means extending from said trough forwardly through said front wall, said rear plate portion being sealed against the upper surface of said manifold housing to cover said trough;

(c) means for providing a source of pressurized air to said trough;

(d) whereby when the lower surface of said manifold rests on the upper fabric ply, a thin sheet of air is directed across the surface of said upper ply toward the front edge thereof and the downwardly and upwardly inclined intermediate and forward portions thereof aerodynamically lift the edge of said upper ply from the remainder of said stack.

4. The apparatus according to claim 3 wherein said means for moving said aerodynamic lift means in an arcuate path comprises a support arm pivotally mounted at a point intermediate each end of said support arm, one end being pivotally attached to the free end of a linear actuator rod and the other end being attached to said aerodynamic lift means, whereby activation of said linear actuator rod moves said lift means from said pick-up position to said delivery position.

5. The apparatus according to claim 3 wherein said gripping means comprises a stationary support block mounted on an actuator housing and having a planar face forming a first stationary clamping jaw and a second lower clamping jaw pivotally linked to said actuator housing by a linking mechanism, a linear actuator rod slidably mounted within said actuator housing and having the free end thereof in engagement with said linking mechanism for moving said lower jaw back and forth between said receiving position and said clamping position.

6. The apparatus according to claim 5 wherein said electronic test means comprises a proximity switch mounted within said stationary support block and having the sensing face thereof substantially coextensive with the planar face of said stationary clamping jaw, whereby a magnetic field is generated, the position of said lower jaw causing variations in the strength of said magnetic field, the strength of said field being indicative of the distance between the lower jaw and the planar face of said first clamping jaw.

7. The apparatus according to claim 1 wherein said rotatable carousel member comprises a planar member having a plurality of spaced openings therethrough arranged in a circular path thereon, said plurality of fabric bins being mounted on said planar member with each of said bins overlying one of said openings, each of said fabric bins including a vertically reciprocal base plate and upstanding side support elements stationary with respect to said base plate for storing a stack of fabric plies therein.

8. The apparatus according to claim 7 wherein said elevator means is mounted on said face frame at said unloading position in registration with the opening in said planar member thereabove for engaging said base plate through said opening in said planar member, said elevator means being movable between a first position beneath said base frame and a plurality of lifting positions in which said elevator means sequentially lift said base plate higher and higher as fabric plies are removed thereform by said separating means.

9. A device for mechanically removing fabric plies from a stack one at a time comprising:

(a) an aerodynamic lift means comprising an aerodynamic lift means for generating lifting air currents across a substantial portion of the entire width of and adjacent the upper surface of the uppermost fabric ply on either side of the longitudinal centerline and toward a front edge thereof, said aerodynamic lift means comprising an air jet manifold adjacent the upper surface of the uppermost ply for directing said lifting air currents toward a curved air foil positioned in the path of said air currents exiting from said manifold, said air jet manifold including a manifold housing extending across a substantial portion of the entire width of and adjacent the surface of the uppermost fabric ply on either side of the longitudinal centerline thereof when in said pick-up position, said housing including a horizontally extending air outlet means connected to a source of pressurized air and so arranged as to emit a sheet of air across aid substantial portion of the width of said uppermost ply toward the front edge thereof;

(b) means for moving said aerodynamic lift means in an arcuate path from a pick-up position to a delivery position in which the front edge of said fabric ply is presented to a gripping means;

(c) said gripping means including a pair of clamping jaws movable relative to each other between an open receiving position and a closed clamping position with the front fabric edge held therebetween;

(d) an electronic test means for determining the number of fabric plies held between the jaws; and (e) transfer means for moving the gripping means horizontally to transfer the clamped fabric ply from the remainder of the stack.

10. The device according to claim 9 wherein said means for moving said aerodynamic lift means in an arcuate path is returned from said transfer position to said pick-up position responsive to a signal from said test means that the number of plies held in said gripping means is improper and for releasing said pair of clamping jaws upon release to said pick-up position.

11. The device according to claim 9 wherein said clamping jaws are returned to said open position and said fabric ply is returned to its position atop the fabric stack responsive to a fault signal from said electronic test means.

12. The device according to claim 9 wherein the means for moving said aerodynamic lift means in an arcuate path includes a support arm pivotally mounted to a support structure at a point intermediate each end thereof, one end being pivotally attached to the free end of the linear actuator rod and the other end of said support arm being attached to said aerodynamic lift means, whereby activation of said linear actuator rod moves said lift means form said pick-up point adjacent the uppermost ply of fabric to a transfer point where the edge of said uppermost ply is gripped in preparation for transfer.

13. The device according to claim 12 wherein said gripping means comprises a stationary support block mounted on an actuator housing and having a planar face forming one of said pair of clamping jaws pivotally linked to said actuator housing by a linking mechanism, and a linear actuator rod slidably mounted within said actuator housing and having the free end thereof in engagement with said linking mechanism for moving said lower jaw back and forth between said gripping position and release position.

14. The device according to claim 13 wherein said electronic test means is mounted on said stationary jaw and emits a magnetic field, the position of said movable jaw within said magnetic field providing voltage variations of the distance of the movable jaw from the stationary jaw face.

* * * * *